US006326132B1

(12) United States Patent
Toya et al.

(10) Patent No.: US 6,326,132 B1
(45) Date of Patent: Dec. 4, 2001

(54) PHOTOTHERMOGRAPHIC MATERIAL FOR LASER BEAM EXPOSURE

(75) Inventors: Ichizo Toya; Munehisa Fujita, both of Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/503,746

(22) Filed: Feb. 15, 2000

(30) Foreign Application Priority Data

Feb. 15, 1999 (JP) ..... 11-035816

(51) Int. Cl.[7] ..... G03C 1/498; G03C 1/32

(52) U.S. Cl. ..... 430/523; 430/531; 430/619; 430/631; 430/950

(58) Field of Search ..... 430/619, 523, 430/950, 640, 631, 531

(56) References Cited

U.S. PATENT DOCUMENTS 5,468,603 11/1995 Kub .
5,698,380 12/1997 Toya .
5,750,328 * 5/1998 Melpolder et al. ..... 430/619
5,965,348 10/1999 Toya .
5,998,127 12/1999 Toya et al. .

* cited by examiner

*Primary Examiner*—Thorl Chea
(74) *Attorney, Agent, or Firm*—Birch, Stewart, Kolasch & Birch, LLP

(57) ABSTRACT

A photothermographic material for laser exposure excellent in granularity and having no blocking trouble, which comprises a support having provided thereon at least one image formation layer containing at least one silver halide, and at least one non-image recording protective layer provided on the side far away from the support of said image formation layer, wherein said protective layer contains a matte agent composed of an inorganic compound and an organic polymer compound.

17 Claims, 1 Drawing Sheet

PHOTOTHERMOGRAPHIC MATERIAL FOR LASER BEAM EXPOSURE

FIELD OF THE INVENTION

The present invention relates to a photothermographic material for laser beam exposure (hereinafter also referred to as a photothermographic material).

BACKGROUND OF THE INVENTION

In the recent medical field, it has been eagerly desired that the amount of processing waste fluid is reduced, from the viewpoints of environmental preservation and space saving. Accordingly, techniques relating to photothermographic materials for medical diagnosis and photographic technology have been required which can be efficiently exposed with laser image setters or laser imagers and can form sharp black images having high resolution. These photothermographic materials can dispense with the use of processing chemicals of the solution family, so that they can provide to customers heat development systems which are simpler and do not damage the environment.

On the other hand, the recent rapid progress in semiconductor laser technology has made it possible to miniaturize medical image output units. Naturally, techniques of infrared-sensitive heat developable silver halide photographic materials in which semiconductor lasers can be utilized as light sources have been developed. Spectral sensitization techniques are disclosed in JP-B-3-10391 (the term "JP-B" as used herein means an "examined Japanese patent publication"), JP-B-6-52387, JP-A-5-341432 (the term "JP-A" as used herein means an "unexamined published Japanese patent application"), JP-A-6-194781 and JP-A-6-301141, and further, antihalation techniques are disclosed in JP-A-7-13295 and U.S. Pat. No. 5,380,635. In light-sensitive materials based on the assumption that infrared exposure is used, the visible absorption of sensitizing dyes and antihalation dyes can be significantly decreased to easily produce substantially colorless light-sensitive materials.

Such photothermographic materials have hitherto been produced by forming light-sensitive layers comprising organic solvents such as ketones as main ingredients and thermoplastic hydrophobic polymers. However, the organic solvents are used in large amounts, which causes the occurrence of environmental problems or extremely high costs for recovery. Further, it is difficult to promote the efficiency of the production by simultaneous coating in multiple layers, resulting in high costs. Accordingly, photothermographic materials in which aqueous solvent coating is possible have been desired. Studies for making the aqueous solvent coating possible have been conducted. However, when precedence is given to the image quality, blocking is liable to occur. Further improvements have therefore been desired.

SUMMARY OF THE INVENTION

An object of the present invention is to provide a photothermographic material for laser exposure excellent in image quality, particularly in granularity.

Another object of the present invention is to provide a photothermographic material for laser exposure having no blocking trouble and excellent in handling properties.

A further object of the present invention is to provide a photothermographic material for laser exposure having little influence on the environment and low in production costs.

These objects have been attained by the following means:

(1) A photothermographic material for laser exposure comprising a support having provided thereon at least one image formation layer containing at least one light-sensitive silver halide, and at least one non-image recording protective layer provided on the side far away from the support of the image formation layer, wherein the above-mentioned protective layer contains a matte agent composed of an inorganic compound and an organic polymer compound;

(2) The photothermographic material of the above (1), wherein the haze at the time of exposure is 55 or less;

(3) The photothermographic material of the above (1) or (2), wherein the protective layer is formed of a coating solution containing gelatin as a main ingredient and water as a main ingredient of a solvent;

(4) The photothermographic material of any one of the above (1) to (3), wherein said at least one image formation layer and said at least one protective layer are formed by simultaneous coating in multiple layers;

(5) The photothermographic material of any one of the above (1) to (4), wherein the above-mentioned matte agent has a volume average particle size of 3 $\mu$m to 10 $\mu$m;

(6) The photothermographic material of any one of the above (1) to (5), wherein the outermost protective layer contains a fluorine surfactant;

(7) The photothermographic material of any one of the above (1) to (6), wherein the above-mentioned matte agent is contained in the protective layer in an amount of 5 mg to 300 mg per $m^2$ of support; and (8) The photothermographic material of any one of the above (1) to (7), wherein the above-mentioned matte agent contains $TiO_2$.

DETAILED DESCRIPTION OF THE INVENTION

Figure 1:
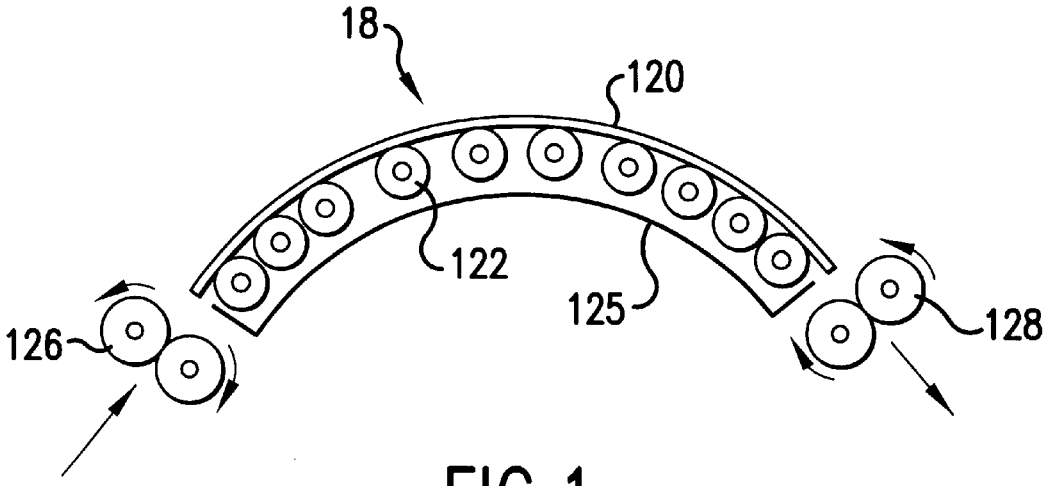
FIG. 1 is a schematic cross sectional view showing a heat developing unit of a plate heater system.

The present invention will be described below in more detail.

Basically, the photothermographic material of the present invention comprises a support having provided thereon at least one image formation layer containing at least one silver halide, and at least one non-image recording protective layer provided on the side far away from the support of the image formation layer.

In such a structure, the protective layer is allowed to contain a matte agent composed of an inorganic compound and an organic polymer, thereby obtaining the photothermographic material excellent in granularity, having no blocking trouble and excellent in photographic properties. Further, it becomes possible to form layers, including the protective layer, by aqueous solvent coating using coating solutions in which water is used as a main ingredient of a solvent, so that this is advantageous in terms of cost and environment. Furthermore, when the image formation layer is formed by the aqueous solvent coating, simultaneous coating in multiple layers in which an upper layer is formed before drying of a lower layer, as represented by a system in which the upper layer and the lower layer are simultaneously formed, becomes possible. This is advantageous in respect to production.

The above-mentioned protective layer is provided for preventing adhesion of the image formation layer.

Although binders for the protective layers used in the present invention may be any polymers, it is preferred that they contain carboxylic acid residue-containing polymers in an amount of 100 mg/m$^2$ to 5 g/m$^2$. The carboxylic acid residue-containing polymers as used herein include natural polymers (gelatin and alginic acid), modified natural polymers (carboxymethyl cellulose and phthalated gelatin) and synthetic polymers (polymethacrylates, polyacrylates, polyalkyl methacrylate/acrylate copolymers and polystyrene/polymethacrylate copolymers). The amount of carboxyl residues contained in said polymer is preferably $1\times10^{-2}$ mmol to 1.4 mol per 100 g of polymer. Further, the carboxylic acid residues may form salts with alkali metal ions, alkaline earth metal ions or organic cations.

When aqueous solvent simultaneous coating in multiple layers, a preferred embodiment of the present invention, is carried out, gelatin is preferred from the viewpoint of prevention of drying marks. Delimed gelatin is particularly preferred because of its high gelation speed.

Two or more protective layers can be used as so desired, and can be designed so that the coating properties and the production suitability are compatible with the image quality, by selecting addition layers to which additives relating to development, film surface pH adjusting agents, charge control agents, ultraviolet absorbers, lubricants, hardeners or surfactants are added.

The protective layer used in the present invention contains the matte agent as an anti-adhesion material good in granularity. In the present invention, as the matte agent, a matte agent composed of an inorganic compound and an organic polymer compound is used. When two or more protective layers are used, the matte agent used in the present invention may be contained in any protective layer. It is preferred that the matte agent is contained in the outermost protective layer. As to the matte agent used in the present invention, there is no particular limitation on its composition. However, preferred examples thereof include mixtures of fine powders of inorganic compounds such as barium sulfate, titanium dioxide, barium strontium sulfate and silicon dioxide and pulverized fractions of organic polymer compounds such as polytetrafluoro-ethylene, cellulose acetate, polystyrene, polymethyl methacrylate, polyethylene carbonate and starch. Particularly preferred is a mixture of titanium oxide and a pulverized fraction of polymethyl methacrylate.

The matte agent used in the present invention can be prepared by adding the fine powders of the organic polymer compound and the inorganic compound to an aqueous solution (preferably containing a dispersing agent (for example, a surfactant)) of a protective colloid (for example, gelatin or polyvinyl alcohol (PVA)), and mixing them by a pulverizing means such as a homogenizer.

The inorganic compound/organic polymer compound mixing weight ratio is preferably from 0.001 to 1, and more preferably from 0.01 to 0.5.

The particle size of the matte agent used in the protective layer in the present invention is preferably from 3 $\mu$m to 10 $\mu$m, and particularly preferably from 4 $\mu$m to 10 $\mu$m, in the volume average particle size.

The amount thereof used is from 1 mg/m$^2$ to 400 mg/m$^2$, and more preferably from 5 mg/m$^2$ to 300 mg/m$^2$, when represented by the amount coated per m$^2$ of light-sensitive material. It is particularly preferred that particles having a particle size of 4 $\mu$m or more are contained in an amount of 5 mg/m$^2$ to 150 mg/m$^2$. When the matte agent is contained in two or more protective layers, the total amount corresponds to the above-mentioned amount.

As to the matte degree on the surface side of the image formation layer, a Beck smoothness is preferably from 50 seconds to 10,000 seconds, and particularly preferably from 80 seconds to 10,000 seconds.

In the matte agent used in the present invention, a transparent matte agent may be used in combination.

In a preferred embodiment of the present invention, the fluorine surfactant is contained in the outermost protective layer on the surface side of the image formation layer, together with the matte agent used in the present invention. Specific examples of the fluorine surfactants include fluorine polymer surfactants described in JP-A-62-170950 and U.S. Pat. No. 5,380,644, and fluorine surfactants described in JP-A-60-244945 and JP-A-63-188135. The use of the fluorine surfactants in combination with the matte agent of the present invention enhances the blocking resistance. The fluorine surfactant is contained in the outermost protective layer preferably in an amount of 1 mg/m$^2$ to 30 mg/m$^2$, more preferably in an amount of 1 mg/m$^2$ to 20 mg/m$^2$.

The image formation layers used in the present invention can contain various kinds of dyes and pigments from the viewpoint of improvements in tones and prevention of irradiation.

Although any dyes and pigments may be used in the image formation layers of the present invention, for example, dyes and pigments described in Color Index can be used. Specific examples thereof include organic dyes such as pyrazoloazole dyes, anthraquinone dyes, azo dyes, azomethine dyes, oxonol dyes, carbocyanine dyes, styryl dyes, triphenylmethane dyes, indoaniline dyes and indophenol dyes, organic pigments including azo pigments, polycyclic pigments (phthalocyanine pigments and anthraquinone pigments), dyeing lake pigments and azine pigments, and inorganic pigments. Preferred examples of the dyes used in the present invention include anthraquinone dyes (for example, compounds 1 to 9 described in JP-A-5-341441, and compounds 3-6 to 3-18 and 3-23 to 3-38 described in JP-A-5-165147), azomethine dyes (compounds 17 to 47 described in JP-A-5-341441), indoaniline dyes (for example, compounds 11 to 19 described in JP-A-5-289227, compound 47 described in JP-A-5-341441, and compounds 2-10 and 2-11 described in JP-A-5-165147), and azo dyes (compounds 10 to 16 described in JP-A-5-341441). Preferred examples of the pigments include indanthrone pigments of the anthraquinone family (C.I. Pigment Blue 60), phthalocyanine pigments (copper phthalocyanine such as C.I. Pigment Blue 15 and non-metal phthalocyanine such as C.I. Pigment Blue 16), triarylcarbonyl pigments of the dyeing lake pigment family, indigo and inorganic pigments (ultramarine blue and cobalt blue). These dyes and pigments may be added in any forms such as solutions, emulsions and fine solid particle dispersions, or in state where the dyes are mordanted with polymer mordants. Although the amount of these compounds used is determined depending upon the desired amount to be absorbed, it is generally preferred that they are used in an amount of 1 $\mu$g to 1 g per m$^2$ of light-sensitive material. For adjusting reddish colors, dioxane pigments, quinacridone pigments or diketopyrrolopyrrole may be used in combination.

The filter dyes are used in such an amount as to give an absorbance at an exposure wavelength of preferably 0.1 to 3.0, more preferably 0.2 to 1.5. When the maximum absorption wavelength of the dyes is within the visible region, the above-mentioned absorbance is preferably from 0.05 to 0.4.

The photothermographic materials are further described below.

The photothermographic materials are preferably of a mono-sheet type (a type in which images can be formed on the photothermographic materials without the use of other sheets such as image receiving materials). The present invention is particularly effective in photothermographic materials for red to infrared exposure.

The photothermographic materials comprise the light-sensitive (image formation) layers containing light-sensitive silver halides (catalytic active amounts of photocatalysts) and the non-image recording protective layers. The light-sensitive layers further preferably contain binders (generally, synthetic polymers), organic silver salts (reducible silver sources) and reducing agents. Furthermore, they preferably contain hydrazine compounds (superhigh contrast enhancers) and color tone adjusting agents (controlling a color tone of silver). A plurality of light-sensitive layers may be provided. For example, for adjusting gradation, a high-sensitivity light-sensitive layer and a low-sensitivity light-sensitive layer can be provided in the photothermographic material. As to the order of arranging the high-sensitivity light-sensitive layer and the low-sensitivity light-sensitive layer, either the high-sensitivity light-sensitive layer or the low-sensitivity light-sensitive layer may be arranged below (on the support side).

Light-insensitive layers may be provided as other functional layers such as surface protective layers, in addition to dye-containing layers, that is to say, filter layers and anti-halation layers.

The haze at the time of exposure of the photothermographic materials of the present invention is preferably 55 or less, and more preferably 47 or less. Although there is no particular limitation on the lower limit thereof, it is usually 15.

The haze of the photothermographic materials can be measured with a haze measuring device, MODEL 1001DP, manufactured by Nippon Denshoku Co., Ltd.

As the supports of the photothermographic materials, paper, parchment, cloth, sheets or thin films of metals (for example, aluminum, copper, magnesium and zinc), glass, glass coated with metals (for example, chromium alloys, steel, silver, gold and platinum) and plastic films are used. Transparent plastic films are preferred, and examples of the plastics used for the supports include polyalkyl methacrylates (for example, polymethyl methacrylate), polyesters (for example, polyethylene terephthalate: PET), polyvinyl acetals, polyamides (for example, nylon), and cellulose esters (for example, cellulose nitrate, cellulose acetate, cellulose acetate propionate and cellulose acetate butyrate). The thickness of the supports is particularly preferably from 90 $\mu$m to 190 $\mu$m, and more preferably from 150 $\mu$m to 185 $\mu$m.

The supports may be coated with polymers. Examples of the polymers include polyvinylidene chloride, acrylic acid polymers (for example, polyacrylonitrile and polymethyl acrylate), polymers of unsaturated dicarboxylic acids (for example, itaconic acid and acrylic acid), carboxymethyl cellulose and polyacrylamide. Copolymers may be used. Instead of the coating with the polymers, undercoat layers containing the polymers may be provided.

As the silver halides, any of silver bromide, silver iodide, silver chloride, silver chlorobromide, silver iodobromide and silver chloroiodobromide can be used. The distribution of the halogen composition in grains may be uniform, vary stepwise, or vary continuously. Further, silver halide grains having the core/shell structure can be preferably used. Double to fivefold structure type core/shell grains can be preferably used, and double to fourfold structure type core/shell grains can be more preferably used. Furthermore, silver bromide can be preferably localized on the surfaces of silver chloride or silver chlorobromide grains.

The grain size of silver halide grains is from 0.001 $\mu$m to 0.04 $\mu$m, and preferably from 0.005 $\mu$m to 0.04 $\mu$m. The grain size of the silver halide grains as used in the present invention is a value obtained by determining a circle-corresponding diameters from projected areas by the use of an electron microscope and averaging them.

The amount of silver halide added is represented by an amount coated per $m^2$ of light-sensitive material. It is preferably from 0.03 $g/m^2$ to 0.6 $g/m^2$, more preferably from 0.05 $g/m^2$ to 0.4 $g/m^2$, and most preferably from 0.1 $g/m^2$ to 0.4 $g/m^2$.

Methods for forming the light-sensitive silver halides are well known in the art. For example, methods described in *Research Disclosure,* No. 17029 (June, 1978) and U.S. Pat. No. 3,700,458 can be used. Specifically, the silver halides are prepared as silver halide emulsions by the reaction of silver nitrate with soluble halides. The silver halides maybe prepared by allowing silver soap to react with halogen ions, thereby converting soap moieties of the silver soap to halogen. Further, halogen ions may be added in forming silver soap.

In general, the silver halides are spectrally sensitized, and then used. Spectral sensitizing dyes are described in JP-A-60-140335, JP-A-63-159841, JP-A-63-231437, JP-A-63-259651, JP-A-63-304242, JP-A-63-15245, U.S. Pat. Nos. 4,639,414, 4,740,455, 4,741,966, 4,751,175 and 4,835,096.

The reducing agents preferably used in the present invention include phenidone, hydroquinone, cathecol and hindered phenols. The reducing agents are described in U.S. Pat. Nos. 3,770,448, 3,773,512, 3,593,863 and 4,460,681, *Research Disclosure,* Nos. 17029 and 29963.

Examples of the reducing agents include aminohydroxycycloalkenone compounds (for example, 2-hydroxypiperidino-2-cyclohexenone), N-hydroxyurea derivatives (for example, N-p-methylphenyl-N-hydroxyurea), hydrazones of aldehydes or ketones (for example, anthracenealdehydephenylhydrazone), phosphor amidophenols, phosphor amidoanilines, polyhydroxybenzenes (for example, hydroquinone, t-butylhydroquinone, isopropylhydroquinone and 2,5-dihydroxyphenylmethylsulfone), sulfohydroxamic acids (for example, benzenesulfohydroxamic acid), sulfonamidoanilines (for example, 4-(N-methane-sulfonamido) aniline), 2-tetrazolylthiohydroquinones (for example, 2-methyl-5-(1-phenyl-5-tetrazolylthio)hydroquinone), tetrahydroquinoxalines (for example, 1,2,3,4-tetrahydroquinoxaline), amidoxines, combinations of azines (for example, aliphatic carboxylic acid allylhydrazides) and ascorbic acid, a combination of polyhydroxybenzene and hydroxylamine, reductons, hydrazine, hydroxamic acids, combinations of azines and sulfonamidophenols, $\alpha$-cyanophenylacetic acid derivatives, combinations of bis-$\beta$-naphthol and 1,3-dihydroxybenzene derivatives, 5-pyrazolone derivatives, sulfonamidophenols, 2-phenylindane-1,3-dione, chroman, 1,4-dihydropyridine derivatives (for example, 2,6-dimethoxy-3,5-dicarboethoxy-1,4-dihydropyridine), bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 1,1-bis(2-hydroxy-3,5-dimethylphenyl)-3, 5,5-trimethylhexane and 4,4-ethylidene-bis(2-t-butyl-6-methyl)phenol), ultraviolet ray-sensitive ascorbic acid derivatives and 3-pyrazolidone derivatives. Aminoreducton esters (for example, piperidinohexosereducton monoacetate) functioning as precursors of reducing agents may be used as the reducing agents.

The particularly preferred reducing agents are hindered phenols.

The reducing agents are added preferably in an amount of 0.01 $g/m^2$ to 5.0 $g/m^2$, and more preferably in an amount of 0.1 $g/m^2$ to 3.0 $g/m^2$.

It is preferred that the light-sensitive layers and the light-insensitive layers contain the binders. As the binders, colorless transparent or translucent polymers are generally used.

The effect of the present invention is improved, when the light-sensitive layer is formed by applying a coating solution in which 30% by weight or more of a solvent is water, and drying it, further when the main binder (70% by weight or more, preferably 80% by weight or more of the total binder of the light-sensitive layer) of the light-sensitive layer comprises a polymer latex soluble or dispersible in an aqueous solvent (water solvent) and particularly having an equilibrium moisture content at 25° C., 60% RH of 2% by weight or less. The polymer latex prepared so as to give an ionic conductivity of 2.5 ms/cm or less is most preferred. Methods for preparing such a polymer latex include a method of purifying a polymer with a separation membrane after polymer synthesis.

The term "aqueous solvent in which the main binder of the light-sensitive layer (hereinafter also referred to as the polymer of the present invention) is soluble or dispersible" as used herein means water or a mixture of water and 70% by weight or less of a water-miscible organic solvent. The water-miscible organic solvents include, for example, alcohols such as methyl alcohol, ethyl alcohol and isopropyl alcohol, cellosolve derivatives such as methyl cellosolve, ethyl cellosolve and butyl cellosolve, ethyl acetate and dimethylformamide.

When the polymer is not dissolved thermodynamically to exist in a so-called dispersion state, the term "aqueous solvent" is also used herein.

The term "equilibrium moisture content at 25° C., 60% RH" as used in this invention can be expressed using the weight W1 of a polymer in moisture conditioning equilibrium in the atmosphere of 25° C. and 60% RH and the weight W0 of the polymer in the absolute dry condition at 25° C. as follows:

$$\text{Equilibrium Moisture Content at } 25^\circ\text{ C., } 60\%\text{ RH} = [(W1 - W0)/W0] \times 100 \text{ (\% by weight)}$$

For the definition of the moisture content and the measuring method thereof, reference can be made to *Polymer Engineering Course* 14, *Test Methods of Polymer Materials* (edited by Kobunshi Gakkai, Chijin Shokan).

The equilibrium moisture content at 25° C., 60% RH of the polymers of the present invention is preferably 2% by weight or less, more preferably from 0.01% to 1.5% by weight, and still more preferably from 0.02% to 1% by weight.

There is no particular limitation on the polymers of the present invention, as long as they can be dissolved or dispersed in the above-mentioned aqueous solvents, and have an equilibrium moisture content at 25° C., 60% RH of 2% by weight or less. Of these polymers, ones dispersible in the aqueous solvents are particularly preferred.

Examples of the dispersion states include latexes with fine particles of solid polymers dispersed and dispersions of polymer molecules in a molecular state or forming micelles, and both are preferred.

Examples of the polymers which can be preferably used in the present invention include hydrophobic polymers such as acrylic resins, polyester resins, rubber resins (for example, SBR resins), polyurethane resins, vinyl chloride resins, vinyl acetate resins, vinylidene chloride resins and polyolefin resins. The polymer may be either a straight chain polymer or a branched polymer, and may be crosslinked. Further, the polymer may be either a so-called homopolymer in which a single monomer is polymerized, or a copolymer in which two or more kinds of monomers are polymerized. The copolymer may be either a random copolymer or a block copolymer. The number-average molecular weight of the polymer is preferably from 5,000 to 1,000,000, and more preferably from about 10,000 to 200,000. Too low a molecular weight unfavorably results in insufficient mechanical strength of an emulsion layer, whereas too high a molecular weight causes poor film forming properties.

These polymers used in the present invention are dispersed in aqueous dispersion media. The term "aqueous dispersion media" as used herein means dispersion media having 30% by weight or more of water in their composition. The dispersion state may be any, such as emulsified dispersion, micelle dispersion or dispersion of polymers having hydrophilic sites in their molecules in a molecular state. Of these, latexes are particularly preferred.

Preferred examples of the polymer latexes include the following, in which the polymers are represented by raw material monomers, the numerals in parentheses are percentages by weight, and the molecular weight is the number-average molecular weight.

P-1: Latex of -MMA(70)-EA(27)-MAA(3)- (molecular weight: 37,000)

P-2: Latex of -MMA(70)-2EHA(20)-St(5)-AA(5)-(molecular weight: 40,000)

P-3: Latex of -St(50)-Bu(47)-MAA(3)-(molecular weight: 45,000)

P-4: Latex of -St(68)-Bu(29)-AA(3)-(molecular weight: 60,000)

P-5: Latex of -St(70)-Bu(27)-IA(3)-(molecular weight: 120,000)

P-6: Latex of -St(75)-Bu(24)-AA(1)-(molecular weight: 108,000)

P-7: Latex of -St(60)-Bu(35)-DVB(3)-MAA(2)-(molecular weight: 150,000)

P-8: Latex of -St(70)-Bu(25)-DVB(2)-AA(3)-(molecular weight: 280,000)

P-9: Latex of -VC(50)-MMA(20)-EA(20)-AN(5)-AA(5)-(molecular weight: 80,000)

P-10: Latex of -VDC(85)-MMA(5)-EA(5)-MAA(5)-(molecular weight: 67,000)

P-11: Latex of -Et(90)-MAA(10)- (molecular weight: 12,000)

P-12: Latex of -St(70)-2EHA(27)-AA(3) (molecular weight: 130,000)

P-13: Latex of -MMA(63)-EA(35)-AA(2) (molecular weight: 33,000)

Abbreviations used in the above-mentioned structures indicate the following monomers:

MMA; Methyl methacrylate, EA; Ethyl acrylate, MAA; Methacrylic acid, 2EHA; 2-Ethylhexyl acrylate, St;

Styrene, Bu; Butadiene, AA; Acrylic acid, DVB; Divinylbenzene, VC; Vinyl chloride, AN; Acrylonitrile, VDC; Vinylidene chloride, Et: Ethylene, IA; Itaconic acid The polymer latexes described above are commercially available, and the following polymer latexes can be utilized. Examples of the acrylic resins include Sevian A-4635, 46583 and 4601 (manufactured by Daicel Chemical Industries, Ltd.) and Nipol Lx 811, 814, 821, 820 and 857 (manufactured by Nippon Zeon Co., Ltd), examples of the polyester resins include FINETEX ES 650, 611, 675 and 850 (manufactured by Dainippon Ink & Chemicals, Inc.) and WD-size and WMS (manufactured by Eastman Chemical Co.), examples of the polyurethane resins include HYDRAN AP 10, 20, 30 and 40 (manufactured by Dainippon Ink & Chemicals, Inc.), examples of the rubber resins include LACSTAR 7310K, 3307B, 4700H and 7132C (manufactured by Dainippon Ink & Chemicals, Inc.) and Nipol Lx 416, 410, 438C and 2507 (manufactured by Nippon Zeon Co., Ltd.), examples of the vinyl chloride resins include G351 and G576 (manufactured by Nippon Zeon Co., Ltd.), examples of the vinylidene chloride resins include L502 and L513 (manufactured by Asahi Chemical Industry Co., Ltd.), and examples of the polyolefin resins include Chemipearl S120 and SA100 (manufactured by Mitsui Petrochemical Industries, Ltd.).

These polymer latexes may be used either alone or as a mixture of two or more of them as required.

As the polymer latexes used in the present invention, styrene-butadiene copolymer latexes are particularly preferred. In the styrene-butadiene copolymer latex, the weight ratio of styrene monomer units to butadiene monomer units is preferably from 40:60 to 95:5. Further, the ratio of the styrene monomer units and the butadiene monomer units to the copolymer is preferably from 60% to 99% by weight. The preferred molecular weight range is the same as described above.

The styrene-butadiene copolymer latexes which can be preferably used in the present invention include P-3 to P-8 described above and commercially available LACSTAR-3307B, 7132C and Nipol Lx416.

The light-sensitive layer of the light-sensitive material of the present invention may further contain a hydrophilic polymer such as gelatin, polyvinyl alcohol, methyl cellulose or hydroxypropyl cellulose. The amount of the hydrophilic polymer added is preferably 30% by weight or less, and more preferably 20% by weight or less, of the total binder of the light-sensitive layer.

The light-sensitive layer of the present invention is preferably formed using the polymer latex, and for the amount of binder contained in the light-sensitive layer, the weight ratio of total binder/organic silver salt is preferably from 1/10 to 10/1, and more preferably from 1/5 to 4/1.

Further, the weight ratio of total binder/silver halide is preferably from 400 to 5, and more preferably from 200 to 10.

The total binder amount of the light-sensitive layer of the present invention is preferably from 0.2 g/m$^2$ to 30 g/m$^2$, and more preferably from 1 g/m$^2$ to 15 g/m$^2$. The light-sensitive layers of the present invention may contain crosslinking agents for crosslinking and surfactants for improving coating properties.

In the present invention, the solvent (both the solvent and the dispersing medium are referred to as the solvent herein for brevity) of the coating solution for the light-sensitive layer of the light-sensitive material is an aqueous solvent containing water in an amount of 30% by weight or more. As components other than water, any water-miscible organic solvents such as methyl alcohol, ethyl alcohol, isopropyl alcohol, methyl cellosolve, ethyl cellosolve, dimethylformamide and ethyl acetate may be used. The water content of the solvent of the coating solution is preferably 50% by weight or more, and more preferably 70% by weight or more. Preferred examples of solvent compositions include water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (wherein the numerals are percentages by weight).

It is preferred that the light-sensitive layers further contain the light-insensitive organic silver salts, and such organic silver salts may be further contained in the light-insensitive layers. Organic acids forming the silver salts are preferably long-chain fatty acids. The fatty acids each has preferably 10 to 30 carbon atoms, and more preferably 15 to 25 carbon atoms. Organic silver salt complexes may be used. Ligands of the complexes preferably have a total stability constant of 4.0 to 10.0 to silver ions. The organic silver salts are described in *Research Disclosure,* Nos. 17029 and 29963.

Examples of the organic silver salts include silver salts of fatty acids (for example, gallic acid, oxalic acid, behenic acid, stearic acid, palmitic acid and lauric acid), silver salts of carboxyalkylthioureas (for example, 1-(3-carboxypropyl) thiourea and 1-(3-carboxypropyl)-3,3 -dimethylthiourea, silver complexes of polymer reaction products of aldehydes (for example, formaldehyde, acetaldehyde and butylaldehyde) and hydroxy-substituted aromatic carboxylic acids, silver salts of aromatic carboxylic acids (for example, salicylic acid, benzoic acid, 3,5-dihydroxybenzoic acid and 5,5-thiodisalicylic acid), silver salts or silver complexes of thioenes (for example, 3-(2-carboxyethyl)-4-hydroxymethyl-4-thiazoline-2-thioene and 3-carboxymethyl-4-thiazoline-2-thioene), silver salts or silver complexes of nitrogen acids (for example, imidazole, pyrazole, urazole, 1,2,4-thiazole, 1H-tetrazole, 3-amino-5-benzylthio-1,2,4-triazole and benzotriazole), a silver salt of saccharin, a silver salt of 5-chlorosalicylaldoxime and silver salts of mercaptides. Silver behenate is most preferred. The organic silver salts are used preferably in an amount of 0.05 g/m$^2$ to 3 g/m$^2$, and more preferably in an amount of 0. 3 g/m$^2$ to 2 g/m$^2$, in terms of silver.

It is preferred that the light-sensitive layers further contain the superhigh contrast enhancers, and the superhigh contrast enhancers may be further contained in the light-insensitive layers. When the photothermographic materials are used in the field of printing photography, the reproduction of continuous gradation images or line images by halftone dots is important. The use of the superhigh contrast enhancers can improve the reproducibility of halftone dot images or line images. As the superhigh contrast enhancers, hydrazine compounds, quaternary ammonium compounds or acrylonitrile compounds (described in U.S. Pat. No. 5,545,515) are used. The hydrazine compounds are particularly preferred superhigh contrast enhancers.

The hydrazine compounds include hydrazine ($H_2N$-$NH_2$) and compounds in which at least one hydrogen atom thereof is substituted. As to the substituent group, an aliphatic group, an aromatic group or a heterocyclic group is directly attached to a nitrogen atom of hydrazine, or an aliphatic group, an aromatic group or a heterocyclic group is attached to a nitrogen atom of hydrazine through a connecting group. Examples of the connecting groups include —CO—, —CS—, —$SO_2$—, —POR— (R is an aliphatic group, an aromatic group or a heterocyclic group), —CNH— and combinations thereof.

The hydrazine compounds are described in U.S. Pat. Nos. 5,464,738, 5,496,695, 5,512,411 and 5,536,622, JP-B-6-77138, JP-B-6-93082, JP-A-6-230497, JP-A-6-289520, JP-A-6-313951, JP-A-7-5610, JP-A-7-77783 and JP-A-7-104426.

The hydrazine compounds can be dissolved in appropriate organic solvents, and added to the coating solutions for the light-sensitive layers. Examples of the organic solvents include alcohols (for example, methanol, ethanol, propanol and fluorinated alcohols), ketones (for example, acetone and methyl ethyl ketone), dimethylformamide, dimethyl sulfoxide and methyl cellosolve. Further, solutions in which the hydrazine compounds are dissolved in oil (supplementary) solvents may be emulsified in the coating solutions. Examples of the oil (supplementary) solvents include dibutyl phthalate, tricresyl phosphate, glyceryl triacetate, diethyl phthalate, ethyl acetate and cyclohexanone. Further, solid dispersions of the hydrazine compounds may be added to the coating solutions. The hydrazine compounds can be dispersed with known dispersing devices such as ball mills, Gaulin, Microfluidizer and supersonic dispersing devices.

The amount of the superhigh contrast enhancer added is preferably from $1\times10^{-6}$ mol to $1\times10^{-2}$ mol, more preferably from $1\times10^{-5}$ mol to $5\times10^{-3}$ mol, and most preferably from $2\times10^{-5}$ mol to $5\times10^{-3}$ mol, per mol of silver halide.

In addition to the superhigh contrast enhancers, superhigh contrast accelerators may be used. Examples of the superhigh contrast accelerators include amine compounds (described in U.S. Pat. No. 5,545,505), hydroxamic acids (described in U.S. Pat. No. 5,545,507), acrylonitrile compounds (described in U.S. Pat. No. 5,545,507) and hydrazine compounds (described in U.S. Pat. No. 5,558,983).

It is preferred that the light-sensitive layers and the light-insensitive layers further contain the color tone adjusting agents. The color tone adjusting agents are described in *Research Disclosure,* No. 17029.

Examples of the color tone adjusting agents include imides (for example, phthalimide), cyclic imides (for example, succinimide), pyrazoline-5-one derivatives (for example, 3-phenyl-2-pyrazoline-5-one and 1-phenylurazole), quinazolinone derivatives (for example, quinazoline and 2,4-thiazolidinedione), naphthalimides (for example, N-hydroxy-1,8-naphthalimide), cobalt complexes (for example, cobalt-hexamine trifluoroacetate), mercaptans (for example, 3-mercapto-1,2,4-triazole, 2,4-dimercaptopyrimidine, 3-mercapto-1,2,4-triazole), N-(aminomethyl)aryldicarboxyimides (for example, (N-dimethylaminomethyl)phthalimide), blocked pyrazole derivatives (for example, N,N'-hexamethylene-1-carbamoyl-3,5-dimethylpyrazole), combinations of isothiuronium derivatives (for example, 1,8-(3,6-dioxaoctane)-bis (isothiuronium trifluoroacetate) and photobleaching agents (for example, 2-(tribromomethylsulfonyl)benzothiazole), merocyanine dyes (for example, 3-ethyl-5-((3-ethyl-2-benzothiazolinylidene)-1-methylethylidene)-2-thio-2,4-oxazolidinedione), phthalazinone compounds and metal salts thereof (for example, phthalazinone, 4-(1-naphthyl)-phthalazinone, 6-chlorophthalazinone, 5,7-dimethyloxyphthalazinone, 2,3-dihydro-1,4-phthalazinedione and 8-methylphthalazinone, combinations of phthalazinone compounds and sulfinic acid derivatives (for example, sodium benzenesulfinate), combinations of phthalazinone compounds and sulfonic acid derivatives (for example, sodium p-toluene sulfonate), phthalazine and derivatives thereof (for example, phthalazine, 6-isopropylphthalazine and 6-methylphthalazine, combinations of phthalazine derivatives and phthalic acid, combinations of phthalazine or phthalazine adducts and dicarboxylic acids (preferably o-phenylene acids) or anhydrides thereof (maleic anhydride, phthalic acid, 2,3-naphthalenedicarboxylic acid, phthalic anhydride, 4-methyl-phthalic acid, 4-nitrophthalic acid and tetrachlorophthalic anhydride), quinazolinedione derivatives, benzoxazine derivatives, naphthoxazine derivatives, benzoxazine-2,4-dione derivatives (for example, 1,3-benzoxazine-2,4-dione), pyrimidine derivatives, asymmetric triazine derivatives (for example, 2,4-dihydroxypyrimidine), and tetraazapentalene derivatives (for example, 3,6-dimercapto-1,4-diphenyl-1H,4H-2,3a,5,6a-tetraazapentalene). Phthalazine derivatives are particularly preferred.

The color tone adjusting agents are contained in surfaces of the light-sensitive layers preferably in an amount of 0.1 mol % to 50 mol %, more preferably in an amount of 0.5 mol % to 20 mol %, per mol of silver.

Antifoggants may be added to the light-sensitive layers or the light-insensitive layers (preferably to the light-sensitive layers). As the antifoggants, non-mercury compounds (described in U.S. Pat. Nos. 3,874,946, 4,546,075, 4,452,885, 4,756,999 and 5,028,523, British Patent Application Nos. 92221383.4, 9300147.7 and 9311790.1 and JP-A-59-57234) are preferably used rather than mercury compounds (described in U.S. Pat. No. 3,589,903).

The particularly preferred antifoggants are heterocyclic compounds having methyl groups substituted by halogen (F, Cl, Br or I).

Surfactants, antioxidants, stabilizers, plasticizers, ultraviolet absorbers or auxiliary coating agents may be further added to the photothermographic materials. The various additives are added to either the light-sensitive layers or the light-insensitive layers. For those, reference can be made to the descriptions of WO98/36322, EP-A-803764, JP-A-10-186567 and JP-A-10-18568.

In the light-sensitive layers used in the present invention, polyhydric alcohols (for example, glycerol and diols described in U.S. Pat. No. 2,960,404), fatty acids or esters described in U.S. Pat. Nos. 2,588,765 and 3,121,060 and silicone resins described in British Patent 955,061 can be used as plasticizers and lubricants.

The photothermographic materials of the present invention may also contain azolium salts or benzoic acid derivatives for obtaining high sensitivity and preventing fog. The azolium salts include compounds represented by general formula (XI) described in JP-A-59-193447, compounds described in JP-B-55-12581 and compounds represented by general formula (II) described in JP-A-60-153039. Any benzoic acid derivatives may be used in the present invention. However, preferred examples thereof include compounds described in U.S. Pat. Nos. 4,784,939 and 4,152,160, JP-A-9-329865, JP-A-9-329864 and JP-A-9-281637. The azolium salts or the benzoic acid derivatives used in the present invention may be added to any sites of the light-sensitive materials. However, they are preferably added to layers on faces having the light-sensitive layers, and more preferably to organic silver salt-containing layers. The azolium salts or the benzoic acid derivatives used in the present invention may be added at any stages of the preparation of the coating solutions. When added to the organic silver salt-containing layers, they may be added at any stages from the preparation of the organic silver salts to the preparation of the coating solutions, preferably from after the preparation of the organic silver salts to immediately before coating. The azolium salts or the benzoic acid derivatives used in the present invention may be added to the coating solutions in any forms such as solutions, powders or fine solid particle dispersions. Further, they may be added as solutions in which they are mixed with other additives such as sensitizing dyes, reducing agents and color toning agents.

The azolium salts or the benzoic acid derivatives used in the present invention may be added in any amount, but preferably in an amount of $1\times10^{-6}$ mol to 2 mol, more preferably in an amount of $1\times10^{-3}$ mol to 0.5 mol, per mol of silver.

In the present invention, the light-sensitive materials may contain mercapto compounds, disulfide compounds or thione compounds for inhibiting or accelerating development to control the development, improving the spectral sensitizing efficiency and improving keeping quality before and after development.

Such mercapto compounds, disulfide compounds and thione compounds are described in JP-A-10-62899, paragraph Nos. 0067 to 0069 and EP-A-0803764, page 20, lines 36 to 56.

Mercapto-substituted aromatic heterocyclic compounds are preferred among others, and include 2-mercaptobenzimidazole, 2-mercapto-5-methylbenzimidazole, 2-mercaptobenzoxazole, 2-mercaptobenzothiazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercapto-purine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercapto-pyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole and 3-mercapto-4-phenyl-5-heptyl-1,2,4-triazole.

The amount of these mercapto compounds added is preferably 0.001 mol to 1.0 mol, and more preferably 0.01 mol to 0.3 mol, per mol of silver in the emulsion layers (preferably, the light-sensitive layers).

In the present invention, decolorizing dyes and base precursors are preferably added to the light-insensitive layers of the photothermographic materials to allow the light-insensitive layers to function as filter layers or antihalation layers. The photothermographic materials generally have the light-insensitive layers, in addition to the light-sensitive layers. The light-insensitive layers can be classified into (1) protective layers provided on the light-sensitive layers (on the side far away from the supports), (2) intermediate layers provided between a plurality of light-sensitive layers or between the light-sensitive layers and the protective layers, (3) undercoat layers provided between the light-sensitive layers and the supports, and (4) back layers provided on the side opposite to the light-sensitive layers, according to their arrangement. The filter layers are provided in the light-sensitive materials as the layers of (1) or (2). The antihalation layers are provided in the light-sensitive materials as the layers of (3) or (4).

The decolorizing dye and the base precursor are preferably added to the same light-insensitive layer. However, they may be separately added to two adjacent light-insensitive layers. Further, a barrier layer may be provided between the two light-insensitive layers. In the present specification, the term "a layer containing a decolorizing dye and a base precursor" also include "a plurality of layers", that is to say, the case where a plurality of layers adjacent to each other contain a decolorizing dye and a base precursor separately.

As methods for adding the decolorizing dyes to the light-insensitive layers, methods of adding solutions, emulsions, fine solid particles dispersions or impregnated polymers to the coating solutions for the light-insensitive layers can be employed. Further, dyes may be added to the light-insensitive layers, using polymer mordants. These addition methods are similar to those for adding dyes to the usual photothermographic materials. Latexes used for the impregnated polymers are described in U.S. Pat. No. 4,199,363, West German Patent Publication (OLS) Nos. 2,541,274 and 2,541,230, EP-A-029104 and JP-B-53-41091. Further, emulsifying methods of adding dyes to solutions in which polymers are dissolved are described in WO88/00723.

The amount of the decolorizing dyes added is determined depending on their use. In general, they are used in such an amount that the optical density (absorbance) measured at a desired wavelength exceeds 0.1. The optical density is preferably from 0.2 to 2. The amount of the dyes used for obtaining such optical density is generally from about 0.001 $g/m^2$ to about 1 $g/m^2$, preferably from about 0.005 $g/m^2$ to about 0.8 $g/m^2$, and particularly preferably from about 0.01 $g/m^2$ to about 0.2 $g/m^2$.

The decolorization of dyes according to the present invention can reduce the optical density to 0.1 or less. Two or more kinds of decolorizing dyes may be used in combination in heat decolorization type recording materials or the photothermographic materials. Similarly, two or more kinds of base precursors may also be used in combination.

The light-sensitive materials of the present invention may have antistatic or conductive layers such as layers containing soluble salts (for example, chlorides and nitrates), metal-deposited layers, ionic polymer-containing layers described in U.S. Pat. Nos. 2,861,056 and 3,206,312, and/or insoluble inorganic salt-containing layers described in U.S. Pat. No. 3,428,451.

Methods for obtaining color images by using the photothermographic materials of the present invention include methods described in JP-A-7-13295, page 10, left column, line 43 to page 11, left column, line 40. Further, examples of stabilizers for color dye images are described in British Patent 1,326,889, U.S. Pat. Nos. 3,432,300, 3,698,909, 3,574,627, 3,573,050, 3,764,337 and 4,042,394.

Any coating methods may be employed for the production of the photothermographic materials of the present invention. Specifically, various coating operations including extrusion coating, slide coating, curtain coating, dip coating, knife coating, flow coating and extrusion coating using a hopper described in U.S. Pat. No. 2,681,294 are used. Extrusion coating described in Stephen F. Kistler and Petert M. Schweizer, *LIQUID FILM COATING,* pages 399 to 536, published by CHAPMAN & HALL (1997) or slide coating is preferably used, and slide coating is particularly preferably used. Examples of the shapes of slide coaters used in slide coating are shown in ibid, FIG. 11b. 1 on page 427. Two or more layers can be simultaneously formed by methods described in ibid., pages 399 to 536, U.S. Pat. No. 2,761,791 and GB-837,095, as so desired. The simultaneous coating methods are preferably used.

In the present invention, surfactants may be used for improving the coating property and the antistatic property. As the surfactants, any surfactants such as nonionic, anionic, cationic and fluorine surfactants may be appropriately used. Specific examples thereof include fluorine polymer surfactants described in JP-A-62-170950 and U.S. Pat. No. 5,380,644, fluorine surfactants described in JP-A-60-244945 and JP-A-63-188135, polysiloxane surfactants described in U.S. Pat. No. 3,885,965, and polyalkylene oxides and anionic surfactants described in JP-A-6-301140.

The photothermographic materials form images by heating after image exposure. Black silver images are formed by this heat development. The image exposure is carried out by the use of lasers. Preferred examples of the lasers used in the present invention include gas lasers ($Ar^+$ and He—Ne), YAG lasers, dye lasers and semiconductor lasers. Further, semiconductor lasers and second harmonic generating elements can also be used in combination. Red to infrared emission gas or semiconductor lasers are preferred.

As the lasers, single mode lasers can be utilized. Such light-sensitive materials as those of the present invention are low in haze on exposure and tend to develop interference fringes. As methods for preventing the interference fringes from being developed, a method of allowing laser light to be obliquely incident upon the light-sensitive material as disclosed in JP-A-5-113548 and a method utilizing a multimode laser disclosed in WO95/31754 are known, and these methods can be used.

When the light-sensitive materials of the present invention are exposed, it is preferred that they are exposed so that laser light overlaps to make scanning lines invisible, as disclosed in *SPIE,* vol. 169, Laser Printing, pages 116 to 128 (1979), JP-A-4-51043 and WO95/31754.

The laser output is preferably 1 mW or more, and more preferably 10 mW or more. Lasers having a high output of 40 mW or more are particularly preferred. In that case, waves of a plurality of lasers may be combined. The laser beam diameter can be established to about 30 $\mu$m to about 200 $\mu$m in the $1/e^2$ spot size of the Gaussian beam.

The heating temperature in heat development is preferably from 80° C. to 250° C., more preferably from 100° C. to 200° C., and particularly preferably from 100° C. to 140° C. The heating time is generally from 1 second to 2 minutes, preferably from 10 seconds to 60 seconds, and more preferably from 10 seconds to 40 seconds.

As a heat development system, a plate heater system is preferred. In the heat development system according to the plate heater system, methods described in JP-A-11-133572 are preferably used. In these methods, a heat developing apparatus is used in which photothermographic materials with latent images formed are allowed to come into contact with a heating means at a heat developing unit, thereby obtaining visible images. The above-mentioned heating means comprises a plate heater, and a plurality of press rollers are arranged along one side of the above-mentioned plate heater. The above-mentioned photothermographic materials are passed between the above-mentioned press rollers and the above-mentioned plate heater to conduct heat development.

Figure 2:
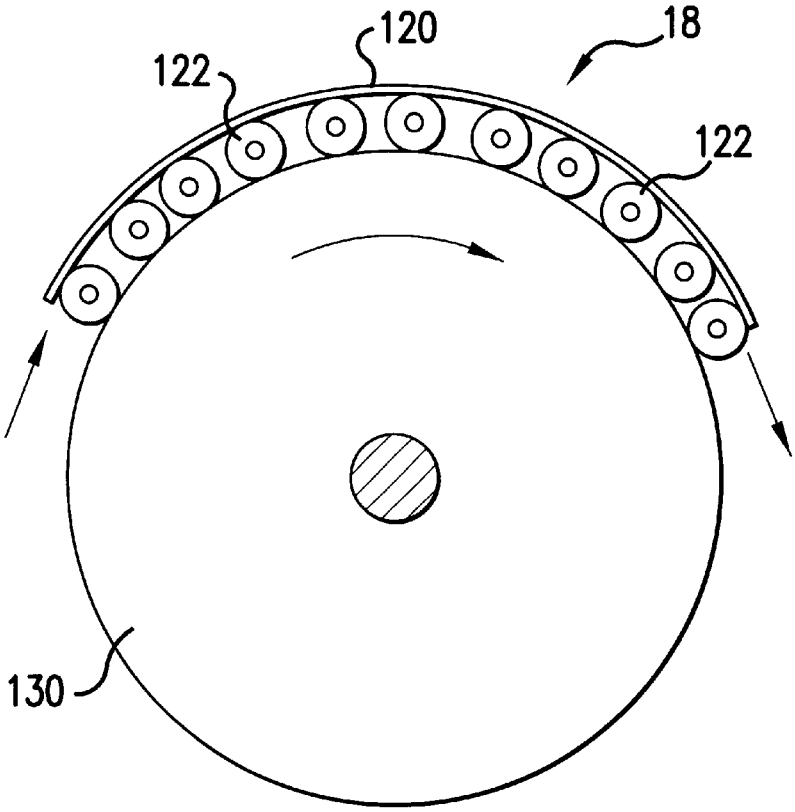
FIG. 2 is a schematic cross sectional view showing another heat developing unit of a plate heater system.

Examples of the heating devices used in heat development include embodiments shown in FIGS. 1 and 2.

A photothermographic material transferred to an image exposure unit is exposed to laser light under laser beam scanning to form a latent image thereon, and then transferred to a heat developing unit with transfer rollers. In that case, dust on a surface and the back side of the photothermographic material is removed with dust removing rollers.

As shown in FIG. 1, the heat developing unit 18 is a unit for conducting heat development to convert the latent image to a visible image by heating the photothermographic material, and comprises a plate heater 120 and a plurality of press rollers 122 arranged opposite to the plate heater 120.

The plate heater 120 is a tabular heating member containing a heating element such as a nichrome wire flatly disposed therein, and the temperature thereof is maintained at a development temperature of the photothermographic material. Further, a surface of this plate heater 120 is preferably coated with a fluorine resin or laminated with a sheet made of a fluorine resin, for decreasing frictional resistance and imparting wear resistance thereto.

Furthermore, volatile ingredients are evaporated from the photothermographic material by heating in heat development, which causes separation of the photothermographic material from the plate heater 120, sometimes resulting in uneven contact of the photothermographic material with the plate heater 120. Then, it is also preferred that minute unevenness is formed on the surface of the plate heater 120 for discharging the vapor.

In addition, for compensating a lowering in temperature at both ends of the plate heater 120 due to radiation of heat, the temperature gradient is preferably formed so that the temperature of both ends becomes higher than that of other portions.

The press rollers 122 are arranged along the entire length of the plate heater 120 in the transfer direction at specified intervals, in contact with one side of the plate heater 120 or separated therefrom by a thickness of the photothermographic material or less, and these press rollers 122 and plate heater 120 form a transfer path for the photothermographic material. The formation of the transfer path for the photothermographic material having a space equal to or less than a thickness of the photothermographic material can prevent the photothermographic material from buckling. A pair of feed rollers 126 for supplying the photothermographic material to the heat developing unit 18 in the direction indicated by the arrow in the figure and a pair of discharge rollers 128 for discharging the photothermographic material in the direction indicated by the arrow in the figure after heat development are disposed at both ends of the transfer path for the photothermographic material.

Further, it is preferred that a heat insulating cover 125 for heat insulation is provided on the press rollers 122 on the side opposite to the plate heater 120.

When a leading edge of the photothermographic material strikes the press rollers 122 in transferring the photothermographic material, the photothermographic material stops momentarily. At that time, when the respective press rollers 122 are spaced at the same interval, the same portion of the photothermographic material stops for every press roller 122, and that portion is urged toward the plate heater 120 for a long period of time. As a result, laterally extending developer streaks are developed on the photothermographic material. Then, it is preferred that the respective press rollers 122 are spaced at uneven intervals.

Further, as shown in FIG. 2, a driving roller 130 whose peripheral surface is an envelope of respective press rollers 122 is installed in contact with the respective press rollers 122, which are driven for rotation by the rotation of the driving roller 130.

In the above description, the plate heater 120 shall include a constitution that a plate member formed of a thermal conductive material and a heat source arranged on the plate member on the side opposite to a surface for heating the photothermographic material.

The present invention will be described in more detail with reference to the following examples.

EXAMPLE 1

(Preparation of Silver Halide Emulsion 1)

To 1421 cc of distilled water, 8 cc of a 1 wt % potassium bromide solution was added, and 8.2 cc of 1 N nitric acid and 20 g of phthalated gelatin were further added thereto. The resulting solution was maintained at 37° C. in a titanium-coated stainless steel reaction pot with stirring. On the other hand, solution A was prepared by diluting 37.04 g of silver nitrate with distilled water to 159 cc, and solution B was prepared by diluting 32.6 g of potassium bromide with distilled water to a volume of 200 cc. The whole amount of solution A was added by the controlled double jet method at a constant flow rate for 1 minute while maintaining the pAg at 8.1 (solution B was added by the controlled double jet method.). Then, 30 cc of a 3.5% aqueous solution of hydrogen peroxide was added, and 36 cc of a 3 wt % aqueous solution of compound 1 was further added. Thereafter, solution A2 was prepared by diluting solution A with distilled water again to 317.5 cc, and solution B2 was prepared by dissolving compound 2 in solution B so as to finally give $1\times10^{-4}$ mol per mol of silver, and diluting it with water to 400 cc, twice the volume of solution B. The whole amount of solution A2 was added by the controlled double jet method at a constant flow rate for 10 minutes while maintaining the pAg at 8.1 (solution B2 was added by the controlled double jet method.). Then, 50 cc of a 0.5 wt % solution of compound 3 in methanol was added, and after the pAg was decreased to 7.5 with silver nitrate, the pH was adjusted to 3.8 using 1 N sulfuric acid. The stirring was stopped, and sedimentation/desalting/washing steps were carried out. Then, 3.5 g of deionized gelatin was added, and 1 N sodium hydroxide was added to adjust the pH and the pAg to 6.0 and 8.2, respectively, to prepare a silver halide dispersion.

Grains in the resulting silver halide emulsion were pure silver bromide grains having an average circle corresponding diameter of 0.053 $\mu$m and a coefficient of variation of sphere corresponding diameters of 18%. The grain size was determined from an average of 1000 grains using an electron microscope. The (100) face ratio of the grains determined by the Kubelka-Munk method was 85%.

The temperature of the emulsion was elevated to 50° C. with stirring, and 5 cc of a 0.5 wt % solution of compound 4 and 5 cc of a 3.5 wt % solution of compound 5 were added. After one minute, compound 6 was added in an amount of $3\times10^{-5}$ mol per mol of silver, and after further 2 minutes, a solid dispersion (an aqueous solution of gelatin) of spectral sensitizing dye A was added in an amount of $5\times10^{-3}$ mol per mol of silver. After still further 2 minutes, a tellurium sensitizer B was added in an amount of $5\times10^{-5}$ mol per mol of silver, followed by ripening for 50 minutes. Just before the ripening was completed, compound 3 was added in an amount of $7\times10^{-3}$ mol per mol of silver, and compound A in an amount of $6.4\times10^{-3}$ mol per mol of silver. Then, the temperature was lowered to terminate the chemical ripening, thereby preparing silver halide emulsion 1.

Before the addition thereof to a coating solution (described later), a 1 wt % aqueous solution of compound B was added in an amount of $7\times10^{-3}$ mol per mol of silver.

(Preparation of Silver Halide Emulsion 2)

An emulsion of pure silver bromide grains having an average circle corresponding diameter of 0.08 $\mu$m and a coefficient of variation of sphere corresponding diameters of 15% was prepared in the same manner as with the preparation of silver halide emulsion 1 with the exception that the solution temperature in forming the grains was changed from 37° C. to 50° C. Similarly to silver halide emulsion 1, sedimentation/desalting/washing/dispersion were carried out.

Further, spectral sensitization, chemical sensitization, and addition of compound 3 and compound A were conducted in the same manner as with emulsion 1 with the exception that the amount of spectral sensitizing dye A added was changed to $4.5\times10^{-3}$ mol per mol of silver, thereby preparing silver halide emulsion 2.

(Preparation of Mixed Emulsion A for Adding to Coating Solution)

Eighty percent by weight of silver halide emulsion 1 and 20% by weight of silver halide emulsion 2 were mixed, and a 1 wt % aqueous solution of compound B was added thereto in an amount of $7\times10^{-3}$ mol per mol of silver.

Compound 1

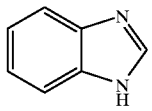

Compound 2

$K_3IrCl_6$

Compound 3

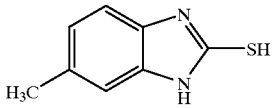

Compound 4

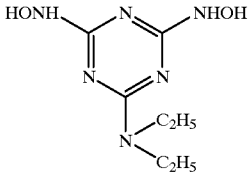

Compound 5

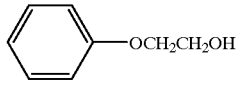

Compound 6

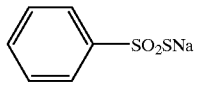

Compound A

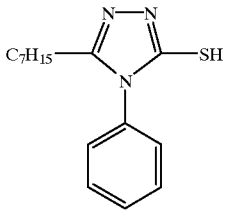

Compound B

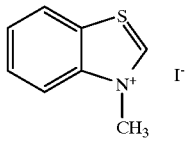

Spectral Sensitizing Dye A

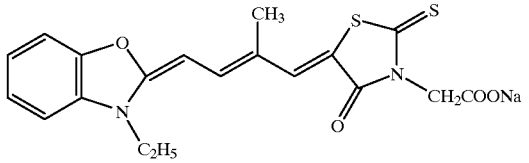

-continued

Tellurium Sensitizer B

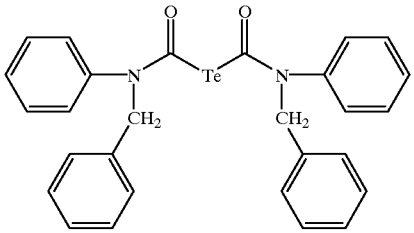

(Preparation of Fatty Acid Silver Salt)

Behenic acid (trade name: Edenor C22-85R, manufactured by Henckel Co.) (87.6 g), 423 ml of distilled water, 49.2 ml of a 5 N aqueous solution of NaOH and 120 ml of tert-butanol were mixed, and stirred at 75° C. for 1 hour to conduct the reaction, thereby obtaining a sodium behenate solution. Separately, 206.2 ml of an aqueous solution of 40.4 g of silver nitrate (pH 4.0) was prepared, and maintained at a temperature of 10° C. A reaction vessel in which 635 ml of distilled water and 30 ml of tert-butanol were placed was maintained at a temperature of 30° C. The whole amount of the above-mentioned sodium behenate solution and the whole amount of the aqueous solution of silver nitrate were added thereto with stirring at a constant flow rate for 62 minute and 10 seconds and 60 minutes, respectively. At this time, only the aqueous solution of silver nitrate was added for 7 minutes and 20 seconds after the addition of the aqueous solution of silver nitrate was initiated, and then the addition of the sodium behenate solution was initiated. For 9 minutes and 30 seconds after the addition of the aqueous solution of silver nitrate was terminated, only the sodium behenate solution was added. At this time, the temperature in the reaction vessel was maintained at 30° C., and the outside temperature was controlled so that the liquid temperature was not elevated. The temperature of a pipe of an addition system of the sodium behenate solution was kept by steam tracing, and the steam opening was adjusted so as to give a liquid temperature of 75° C. at an outlet of a tip of an addition nozzle. Further, the temperature of a pipe of an addition system of the aqueous solution of silver nitrate was kept by circulating cold water through the outer path of a double pipe. A position for adding the sodium behenate solution and that for adding the aqueous solution of silver nitrate were arranged symmetrically centered on a stirring shaft, and adjusted to such a height as they did not come into contact with the reaction solution.

After the addition of the sodium behenate solution was terminated, the resulting solution was allowed to stand wit stirring at that temperature for 20 minutes, and the temperature thereof was lowered to 25° C. Then, solid matter was filtered by suction filtration, and washed with water until a filtrate showed a conductivity of 30 $\mu$S/cm. Thus, a fatty acid silver salt was obtained. The resulting solid matter was not dried and stored as a wet cake.

The shape of the resulting silver behenate particles was evaluated by taking electron micrographs. As a result, they were scaly crystals having an average projected area diameter of 0.52 $\mu$m, an average particle thickness of 0.14 $\mu$m and a coefficient of variation of sphere corresponding diameters of 15%.

To the wet cake corresponding to 100 g of the dried solid matter, 7.4 g of polyvinyl alcohol (trade name: PVA-205) and water were added to make the total weight 385 g, and then the resulting mixture was preliminarily dispersed with a homomixer.

Then, the original fluid preliminarily dispersed was treated three times with a dispersing device (trade name: Microfluidizer M-110S-EH, manufactured by Microfluidex International Corporation, using a G10Z interaction chamber), adjusting its pressure to 1750 kg/cm$^2$. Thus, a dispersion of silver behenate was obtained. For the cooling operation, coiled heat exchangers were each mounted in front of and behind the interaction chamber, and the temperature of a refrigerant was controlled, thereby setting the dispersing temperature to a desired temperature.

(Preparation of 25 Wt % Dispersion of Reducing Agent)

To 80 g of 1,1-bis(2-hydroxy-3,5-dimethylphenyl)-3,5,5-trimethylhexane and 64 g of a 20% aqueous solution of modified polyvinyl alcohol (Poval MP-203, manufactured by Kuraray Co., Ltd.), 176 g of water was added, and sufficiently mixed to prepare a slurry. The slurry was placed in a vessel together with 800 g of zirconia beads having an average diameter of 0.5 mm, and dispersed with a dispersing device (a ¼G sand grinder mill, manufactured by Imex Co.) for 5 hours to obtain a reducing agent dispersion. Reducing agent particles contained in the reducing agent dispersion thus obtained had an average particle size of 0.72 $\mu$m.

(Preparation of 20 Wt % Dispersion of Mercapto Compound)

To 64 g of compound A described above and 32 g of a 20 wt % aqueous solution of modified polyvinyl alcohol (Poval MP-203, manufactured by Kuraray Co., Ltd.), 224 g of water was added, and sufficiently mixed to prepare a slurry. The slurry was placed in a vessel together with 800 g of zirconia beads having an average diameter of 0.5 mm, and dispersed with a dispersing device (a ¼G sand grinder mill, manufactured by Imex Co.) for 10 hours to obtain a mercapto dispersion. Mercapto compound particles contained in the mercapto compound dispersion thus obtained had an average particle size of 0.67 $\mu$m.

(Preparation of 30 Wt % Dispersion of Organic Polyhalogen Compound)

To 48 g of tribromomethylphenylsulfone, 48 g of 3-tribromomethylsulfonyl-4-phenyl-5-tridecyl-1,2,4-triazole and 48 g of a 20 wt % aqueous solution of modified polyvinyl alcohol (Poval MP-203, manufactured by Kuraray Co., Ltd.), 224 g of water was added, and sufficiently mixed to prepare a slurry. The slurry was placed in a vessel together with 800 g of zirconia beads having an average diameter of 0.5 mm, and dispersed with a dispersing device (a ¼G sand grinder mill, manufactured by Imex Co.) for 5 hours to obtain an organic polyhalogen compound dispersion. Polyhalogen compound particles contained in the poyhalogen compound dispersion thus obtained had an average particle size of 0.74 $\mu$m.

(Preparation of 10 Wt % Solution of Phthalazine Compound in Methanol)

In 90 g of methanol, 10 g of 6-isopropylphthalazine was dissolved, and the resulting solution was used.

(Preparation of 20 Wt % Dispersion of Pigment)

To 64 g of C.I. Pigment Blue 60 and 6.4 g of Demol N manufactured by Kao Corp., 250 g of water was added, and sufficiently mixed to prepare a slurry. The slurry was placed in a vessel together with 800 g of zirconia beads having an average diameter of 0.5 mm, and dispersed with a dispersing device (a ¼G sand grinder mill, manufactured by Imex Co.) for 25 hours to obtain a pigment dispersion. Pigment particles contained in the pigment dispersion thus obtained had an average particle size of 0.21 $\mu$m.

(Preparation of 40 Wt % SBR Latex)

The ultrafiltration (UF)-purified SBR latex was obtained in the following manner.

The following SBR latex was diluted with distilled water ten times, and diluted and purified using a module for UF-purification, FSO3-FC-FUYO3A1 (Daisen Membrane System Co.) until the ion conductivity reached 1.5 mS/cm. At this time, the latex concentration was 40 wt %.

(SBR Latex: Latex of -St(68)-Bu(29)-AA(3)-)

Equilibrium moisture content: 0.6 wt % (25° C., 60% RH)

Average particle size: 0.1 μm

Concentration: 45 wt %

Ion conductivity: 4.2 mS/cm (the ion conductivity was measured at 25° C. for a stock solution (40 wt %) of the latex by use of a CM-30S conductivity meter manufactured by Towa Denpa Kogyo Co.)

pH: 8.2

(Preparation of Coating Solution for Emulsion Layer (Light-Sensitive Layer))

The 20 wt % dispersion of the pigment (1.1 g), 103 g of the dispersion of the fatty acid silver salt, 5 g of a 20 wt % aqueous solution of polyvinyl alcohol (PVA-205, manufactured by Kuraray Co., Ltd.), 25 g of the 25 wt % dispersion of the reducing agent, 11.5 g of the 30 wt % dispersion of the organic polyhalogen compound, 3.1 g of the 20 wt % dispersion of the mercapto compound, 106 g of the 40 wt % SBR latex purified by ultrafiltration (UF) and 8 ml of the 20 wt % solution of the phthalazine compound which were obtained above were added, and 10 g of mixed silver halide emulsion A was sufficiently mixed therewith to prepare a coating solution for an emulsion layer. The coating solution was applied so as to give 70 ml/$M^2$.

The viscosity of the above-mentioned coating solution for the emulsion layer was 85 mPa·s at 40° C. (No.1 rotor) , when measured with a B type viscometer of Tokyo Keiki Co., Ltd.

The viscosity of the coating solution at 25° C. measured using an RFS fluid spectrometer manufactured by Rheometric Far East Co. was 1500, 220, 70, 40 and 20 mpa·s at shear rates of 0.1, 1, 10, 100 and 1000 liter/second, respectively.

(Preparation of Coating Solution for Emulsion Surface Intermediate Layer)

To 772 g of a 10 wt % aqueous solution of polyvinyl alcohol (PVA-205, manufactured by Kuraray Co., Ltd.), 0.5 g of the 20 wt % dispersion of the pigment and 226 g of a 27.5% solution of methyl methacrylate/styrene/2-ethylhexyl acrylate/hydroxyethyl methacrylate/acrylic acid copolymer (copolymerization weight ratio: 59/9/26/5/1) latex, 2 ml of a 5 wt % aqueous solution of Aerosol OT (manufactured by American Cyanamide Co.) was added to prepare a coating solution for an intermediate layer, and the solution was applied so as to give 5 ml/$m^2$.

The viscosity of the coating solution was 21 mpa·s, when measured with a B type viscometer at 40° C. (No. 1 rotor).

(Preparation of Coating Solution for First Emulsion Surface Protective Layer)

Inert gelatin (80 g) was dissolved in water, and 0.3 g of the 20 wt % dispersion of the pigment, 64 ml of a 10 wt % solution of phthalic acid in methanol, 74 ml of a 10 wt % aqueous solution of 4-methylphthalic acid, 28 ml of 1 N sulfuric acid and 5 ml of a 5 wt % aqueous solution of Aerosol OT (manufactured by American Cyanamide Co.) were added thereto. Then, water was added thereto to bring the total amount to 1000 g, thus preparing a coating solution for a first emulsion surface protective layer, which was applied so as to give 10 ml/$m^2$.

The viscosity of the coating solution was 17 mpa·s, when measured with a B type viscometer at 40° C. (No. 1 rotor).

(Preparation of Coating Solution for Second Emulsion Surface Protective Layer)

Inert gelatin (100 g) was dissolved in water, and 20 ml of a 5 wt % solution of N-perfluorooctylsulfonyl-N-propylalanine potassium salt as a fluorine surfactant (see Tables 1 and 2, when no fluorine surfactant was added, a portion therefor was replaced by water), 16 ml of a 5 wt % aqueous solution of Aerosol OT (manufactured by American Cyanamide Co.), a matte agent (see Tables 1 and 2), 1.4 g of phthalic acid, 1.6 g of 4-methylphthalic acid, 44 ml of 1 N sulfuric acid and 445 ml of 4 wt % chrome alum were added thereto. Then, water was added to bring the total amount to 2000 g, thus preparing a coating solution for a second emulsion surface protective layer, which was applied so as to give 10 ml/$m^2$.

The viscosity of the coating solution was 9 mPa·s, when measured with a B type viscometer at 40° C. (No. 1 rotor).

Matte agents described in Tables 1 and 2 were prepared as follows.

Preparation of Matte Agents-A (the Invention)

Water was added to 100 g of inert gelatin and 32 cc of surfactant A (a 5 wt % aqueous solution) to bring the total amount to 1580 g, thus preparing solution I, and water was added to 310 g of polymethyl methacrylate (weight-average molecular weight: 20,000) and 760 g of RF-690 (Taipake $TiO_2$having a primary particle size (average particle size) of 0.2 μm, manufactured by Ishihara Sangyo Kaisha Co.) (a 3.3 wt % aqueous dispersion) to bring the total amount of 1070 g, thus preparing solution II. After solution I was mixed with solution II, the resulting mixture was stirred at 30° C. at 300 rpm for 120 minutes using a homogenizer to prepare matte agent A-1 (a slightly turbid matte agent having a volume average particle size of 3 μm).

Slightly turbid matte agents, matte agent A-2 (volume average particle size: 6 μm) and matte agent A-3 (volume average particle size: 9 μm), were prepared in the same manner as described above with the exception that the stirring revolution of the homogenizer was increased.

Preparation of Matte Agents-B (the Invention)

Slightly turbid matte agents higher in turbidity, matte agent B-1 (volume average particle size: 3 μm), matte agent B-2 (volume average particle size: 6 μm) and matte agent B-3 (volume average particle size: 9 μm), were prepared in the same manner as with the preparation of matte agents-A with the exception that the concentration of the aqueous dispersion of RF-690 was increased to 14.7% by weight.

Preparation of Matte Agents-R (Comparison)

Transparent matte agents, matte agent R-1 (volume average particle size: 3 μm), matte agent R-2 (volume average particle size: 6 μm) and matte agent R-3 (volume average particle size: 9 μm), were prepared in the same manner as with the preparation of matte agents-A with the exception that the aqueous dispersion of RF-690 was replaced by water.

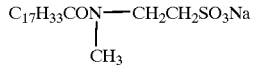

(Preparation of PET Support)

Using terephthalic acid and ethylene glycol, PET having an IV of 0.66 (measured in phenol/tetrachloroethane (having a weight ratio of 6/4) at 25° C.) was obtained. After pelletized, this was dried at 130° C. for 4 hours. Then, this was melted at 300° C., and extruded through a T die, followed by rapid cooling to prepare an unoriented film having such a thickness as to give a film thickness of 175 μm after heat setting.

This unoriented film was oriented lengthwise 3.3 times using rolls different from each other in peripheral speed, and then, oriented crosswise 4.5 times with a tenter. At this time, the temperatures were 110° C. and 130° C., respectively. Then, the oriented film was heat set at 240° C. for 20 seconds, and thereafter relaxed crosswise by 4% at the same temperature. Then, after portions chucked with the tenter was slit off, the knurl treatment was applied to both edges. Then, the resulting film was taken up at 4 kg/cm$^2$ to obtain a roll of the film having a thickness of 175 $\mu$m.

(Surface Corona Treatment)

Both sides of the support were treated with a Model 6KVA solid state corona treating device manufactured by Pillar Co. at room temperature at 20 m/minute. Readings of current and voltage at this time revealed that the support was treated at 0.375 kV·A·min./m$^2$. The treatment frequency at this time was 9.6 kHz, and the gap clearance between an electrode and a dielectric roll was 1.6 mm.

(Preparation of Undercoated Support)

(Preparation of Coating Solution A for Undercoat)

One gram of fine polystyrene particles (average particle size: 0.2 $\mu$m) and 20 ml of surfactant B (1% by weight) were added to 200 ml of an aqueous dispersion of a copolyester, Pesresin A-515GB (30% by weight, manufactured by Takamatsu Oil & Fat Co., Ltd.), and distilled water was added thereto to bring the volume to 1000 ml, thus preparing coating solution A for undercoat.

(Preparation of Coating Solution B for Undercoat on Back Side)

To 680 ml of distilled water, 200 ml of an aqueous dispersion of a styrene-butadiene copolymer (styrene/butadiene/itaconic acid=47/50/3 (weight ratio), concentration: 30% by weight) and 0.1 g of fine polystyrene particles (average particle size: 2.5 $\mu$m) were added, and distilled water was further added thereto to bring the volume to 1000 ml, thus preparing coating solution B for undercoat.

(Preparation of Coating Solution C for Undercoat on Back Side)

Ten grams of inert gelatin was dissolved in 500 ml of distilled water, and 40 g of an aqueous dispersion (40% by weight) of fine particles of a tin oxide-antimony oxide complex described in JP-A-61-20033 was added thereto. Then, distilled water was added thereto to bring the volume to 1000 ml, thus preparing coating solution C for undercoat.

(Preparation of Undercoated Support)

One side (a light-sensitive side) of the biaxial drawing polyethylene terephthalate support having a thickness of 175 $\mu$M was subjected to the above-mentioned corona discharge treatment, and then was coated with the above-mentioned coating solution A for undercoat with a bar coater so as to give a wet amount coated of 5 ml/m$^2$, followed by drying at 180° C. for 5 minutes. The dried film thickness thereof was about 0.3 $\mu$m. Then, the back side thereof was subjected to the corona discharge treatment, and coated with coating solution B for undercoat with a bar coater so as to give a wet amount coated of 5 ml/m$^2$ and a dried film thickness of about 0.3 $\mu$m, followed by drying at 180° C. for 5 minutes. Coating solution C for undercoat was further applied onto it with a bar coater so as to give a wet amount coated of 3 ml/m$^2$ and a dried film thickness of about 0.03 $\mu$m, followed by drying at 180° C. for 5 minutes. Thus, an undercoated support was prepared.

(Preparation of Back Side Coating Solution)

(Preparation of Dispersion (a) of Fine Solid Particles of Base Precursor)

Base precursor compound 11 (64 g), 28 g of diphenyl sulfone compound 12 and 10 g of a surfactant, Demol N manufactured by Kao Corp. were mixed with distilled water, and the mixed solution was subjected to beads dispersion using a sand mill (a ¼ gallon sand grinder mill, manufactured by Imex Co.) to obtain a codispersion of fine solid particles of the base precursor compound and the diphenyl sulfone compound, having an average particle size of 0.2 $\mu$m.

(Preparation of Dispersion of Fine Solid Particles of Dye)

Cyanine dye compound 13 (9.6 g) and 5.8 g of sodium p-alkylbenzenesulfonate were mixed with 305 ml of distilled water, and the mixed solution was subjected to beads dispersion using a sand mill (a ¼ gallon sand grinder mill, manufactured by Imex Co.) to obtain a dispersion of fine solid particles of the dye having an average particle size of 0.2 $\mu$n.

(Preparation of Coating Solution for Antihalation Layer)

PVA-217 (17 g), 9.6 g of polyacrylamide, 70 g of the above-mentioned dispersion (a) of fine solid particles of the base precursor, 56 g of the above-mentioned dispersion of fine solid particles of the dye, 1.5 g of fine polymethyl methacrylate particles (average particle size: 6.5 $\mu$m), 2.2 g of sodium polyethylenesulfonate, 0.2 g of coloring dye compound 14 and 844 ml of $H_2O$ were mixed to prepare a coating solution for an antihalation layer.

(Preparation of Coating Solution For Back Side Protective Layer)

A vessel was kept at 40° C., and 50 g of PVA-117, 0.2 g of sodium polyethylenesulfonate, 2.4 g of N,N'-ethylene-bis (vinylsulfoneacetamide), 1 g of sodium t-octylphenoxyethoxyethanesulfonate, 30 mg of compound 15, 32 g of $C_8F_{17}SO_3K$, 64 mg of $C_8F_{17}SO_2N$ $(C_3H_7)$ $(CH_2CH_2)_4$ $(CH_2)_4$—$SO_3Na$ and 950 ml of $H_2O$ were mixed therein to prepare a coating solution for a back side protective layer.

Surfactant B

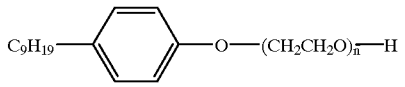

n ≈ 8.5

Base Precursor Compound 11

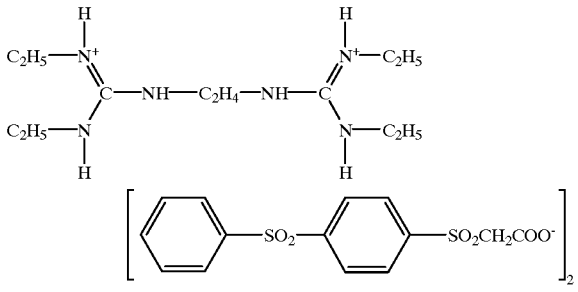

Compound 12

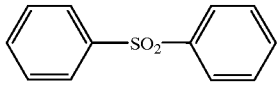

-continued

Cyanine Dye Compound 13

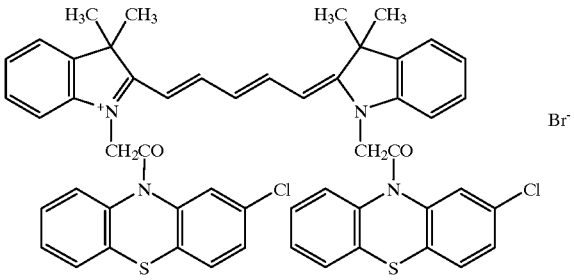

Blue Dye Compound 14

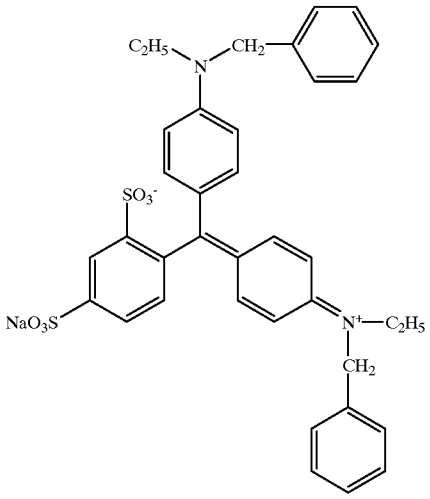

Compound 15

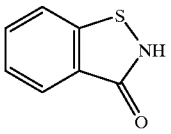

(Preparation of Photothermographic Material)

The above-mentioned undercoated polyethylene terephthalate film (support) was simultaneously coated with the coating solution for the antihalation layer and the coating solution for the protection layer in multiple layers, so as to give an amount of solid matter of the fine solid particle dye coated of 0.04 g/m$^2$ and an amount of PVA coated of 1 g/m$^2$, respectively, followed by drying to prepare an antihalation back layer.

On the side opposite to the back side, the emulsion layer, the intermediate layer, the first protective layer and the second protective layer were simultaneously coated in this order from the undercoat side in multiple layers by a slide bead coating system to prepare a sample of a photothermographic material.

The coating was carried out at a speed of 160 m/minute, and the clearance between a tip of a coating die and the support was set at 0.18 mm. The pressure in a vacuum chamber was set at a pressure 392 Pa lower than atmospheric pressure. In a subsequent chilling zone, air having a dry-bulb temperature of 18° C. and a wet-bulb temperature of 12° C. was blown for 30 seconds to cool the coating solutions. Thereafter, in a helical floating type drying zone, drying air having a dry-bulb temperature of 30° C. and a wet-bulb temperature of 18° C. was blown on the coating solutions for 200 seconds, followed by passing them through the drying zone of 70° C. for 30 seconds. Then, the coating solutions were cooled to 25° C. to evaporate the solvents in the coating solutions. The average speed of the air blown on film faces of the coating solutions in the chilling zone and the drying zone was 7 m/second.

(Form of Processed Goods)

The form was similar to that of processed goods of various sizes of one side light-sensitive materials manufactured by Fuji Photo Film Co., Ltd., with the proviso that an additional similar film was added, and that the film was perforated not to be discharged. Or an imager was contrived so that the film was not discharged.

(Measurement of Haze)

The haze of coated samples was measured using a haze measuring device, Model 1001DP, manufactured by Nippon Denshoku Co., Ltd. As a result, all samples showed values of 42 to 45.

(Evaluation of Granularity)

After exposure with a laser photographic sensitometer provided with 660-nm diodes (details thereof are described below), an exposure so as to give a density of 0.5 when a photographic material was developed at 122° C. for 19 seconds was given, and heat development was carried out. For the resulting image, the RMS value was measured with a microdensitometer having an aperture diameter of 100 $\mu$m, and indicated by a relative value taking the value of sample 1 as100. A lower value shows a better performance. Results thereof are shown in Tables 1 and 2.

Laser Photographic Sensitometer

The output was 35 mW, and two 660-nm diode laser beams were combined (single mode). The Gaussian beam spot 1/e$^2$ was 100 $\mu$m, and the beam was sent in a secondary scanning direction at pitches of 25 $\mu$m, and one pixel was written 4 times.

(Evaluation of Blocking Resistance)

Each light-sensitive material was exposed to white light, and subjected to heat development at 120° C. for 20 seconds. The light-sensitive material was cut to a size of 3 cm square, and moisture conditioned under the conditions of 25° C. and 80% RH for 2 hours. Then, the outermost surface protective layer on the image recording side was superposed on the outermost protective layer on the back side so as to come into contact face to face. Tabular stainless steel plates were overlapped onto both ends, and the light-sensitive materials superposed were placed in a moisture-proof envelop, followed by sealing. Then, a weight of 585 g was placed thereon, and the envelop was stored at 40° C. for 3 days. Thereafter, the light-sensitive materials superposed were taken out of the envelop, and the adhered area of the image recording side with the back side was visually evaluated by percentage indication. Results thereof are shown together in Tables 1 and 2. An adhered area of 20% or less is a level at which no problem arises.

TABLE 1

| Sample | Matte Agent (amount coated: g/m$^2$) | | Fluorine Surfactant | Granularity | Blocking Resistance (%) |
|---|---|---|---|---|---|
| 1 (Comparison) | — | (0) | Not added | 100 | 95 |
| 2 (Comparison) | R-1 | (0.15) | Not added | 150 | 10 |
| 3 (Comparison) | R-2 | (0.15) | Not added | 230 | 5 |
| 4 (Comparison) | R-3 | (0.15) | Not added | 320 | 0 |
| 5 (Invention) | A-1 | (0.15) | Not added | 100 | 10 |
| 6 (Invention) | A-2 | (0.15) | Not added | 110 | 5 |
| 7 (Invention) | A-3 | (0.15) | Not added | 120 | 0 |
| 8 (Invention) | B-1 | (0.15) | Not added | 100 | 10 |
| 9 (Invention) | B-2 | (0.15) | Not added | 100 | 5 |
| 10 (Invention) | B-3 | (0.15) | Not added | 100 | 0 |

TABLE 2

| Sample | Matte Agent (amount coated: g/m$^2$) | | Fluorine Surfactant | Granularity | Blocking Resistance (%) |
|---|---|---|---|---|---|
| 11 (Comparison) | — | (0) | Added | 100 | 93 |
| 12 (Comparison) | R-1 | (0.15) | Added | 150 | 8 |
| 13 (Comparison) | R-2 | (0.15) | Added | 230 | 0 |
| 14 (Comparison) | R-3 | (0.15) | Added | 320 | 0 |
| 15 (Invention) | A-1 | (0.15) | Added | 100 | 8 |
| 16 (Invention) | A-2 | (0.15) | Added | 110 | 0 |
| 17 (Invention) | A-3 | (0.15) | Added | 120 | 0 |
| 18 (Invention) | B-1 | (0.15) | Added | 100 | 8 |
| 19 (Invention) | B-2 | (0.15) | Added | 100 | 0 |
| 20 (Invention) | B-3 | (0.15) | Added | 100 | 0 |

The results showed that the use of the matte agents of the present invention resulted in good granularity and blocking resistance.

Further, samples were similarly prepared with the exception that RF-690 was additionally added to the coating solutions for the second emulsion surface protective layers in samples 2 to 4 and samples 12 to 14 in which matte agents R-1 to R-3 were used, so as to give an amount identical to the amount of RF-690 ($TiO_2$ particles) coated in samples 5 to 7. The granularity of the resulting samples was similar to that of samples 2 to 4 and samples 12 to 14.

Furthermore, when only RF-690 was used in the same amount as that of RF-690 coated in samples 5 to 7 without using matte agents R-1 to R-3, no effect was observed in granularity and blocking resistance.

EXAMPLE 2

Samples were prepared in the same manner as with Example 1 with the exception that latexes Lb1 and Lc1 (both having an equilibrium moisture content of less than 2% by weight) described below were used in place of SBR latex in the emulsion layers.

The same effect according to the matte agents as with Example 1 was obtained.

(Synthesis of Lb1)

In an autoclave made of glass (TEM-V1000 manufactured by Taiatsu Garasu Kogyo Co., Ltd), 140 g of styrene, 280 g of distilled water, 4.44 g of a surfactant (Sandet BL manufactured by Sanyo Chemical Industries, Ltd.) and 6 g of acrylic acid were placed, and stirred for 1 hour in a stream of nitrogen. Then, 54 g of 2-ethylhexyl acrylate was added thereto, and the temperature was elevated to 70° C. Then, 20 g of an aqueous solution of ammonium persulfate (5% by weight) was added thereto, followed by stirring as such for 10 hours. Thereafter, the temperature of the reaction vessel was lowered to room temperature to obtain a styrene-acrylic latex. A 1 N aqueous solution of ammonium was added to this latex to adjust the pH to 7.5.

Thus, latex Lb1 having an average particle size of 98 nm and a concentration of 42% by weight was obtained. The equilibrium moisture content of the polymer under the conditions of 25° C. and 60% RH was 0.7% by weight.

(Synthesis of Lc1)

In an autoclave made of glass (TEM-V1000 manufactured by Taiatsu Garasu Kogyo Co., Ltd), 126 g of methyl methacrylate, 280 g of distilled water, 8.2 g of a surfactant (Sandet BL manufactured by Sanyo Chemical Industries, Ltd.) and 4 g of acrylic acid were placed, and stirred for 1 hour in a stream of nitrogen. Then, 70 g of ethyl acrylate was added thereto, and the temperature was elevated to 60° C. Then, 20 g of an aqueous solution of potassium persulfate (5% by weight) was added thereto, followed by stirring as such for 10 hours. Thereafter, the temperature of the reaction vessel was lowered to room temperature to obtain an acrylic latex. A 1 N aqueous solution of ammonium was added to this latex to adjust the pH to 7.5.

Thus, latex Lc1 having an average particle size of 101 nm and a concentration of 44% by weight was obtained. The equilibrium moisture content of the polymer under the conditions of 25° C. and 60% RH was 0.7% by weight.

According to the present invention, the granularity is good, and the blocking trouble can be prevented.

While the invention has been described in detail and with reference to specific embodiments thereof, it will be apparent to one skilled in the art that various changes and modifications can be made therein without departing from the spirit and scope thereof.

What is claimed is:

1. A photothermographic material for laser exposure comprising a support having provided thereon at least one image formation layer containing at least one light-sensitive silver halide, and at least one non-image recording protective layer provided on the side far away from the support of said image formation layer, wherein said protective layer contains a matte agent composed of an inorganic compound and an organic polymer compound, and wherein the inorganic compound and the organic polymer compound are mixed by pulverizing.

2. The photothermographic material according to claim 1, wherein the haze at the time of exposure is 55 or less.

3. The photothermographic material according to claim 1, wherein the protective layer is formed of a coating solution containing gelatin as a main ingredient and water as a main ingredient of a solvent.

4. The photothermographic material according to claim 1, wherein said at least one image formation layer and said at least one protective layer are formed by simultaneous coating in multiple layers.

5. The photothermographic material according to claim 1, wherein said matte agent has a volume average particle size of 3 $\mu$m to 10 $\mu$m.

6. The photothermographic material according to claim 1, wherein the outermost protective layer contains a fluorine surfactant.

7. The photothermographic material according to claim 1, wherein said matte agent is contained in the protective layer in an amount of 5 mg to 300 mg per $m^2$ of support.

8. The photothermographic material according to claim 1, wherein said matte agent contains $TiO_2$.

9. The photothermographic material according to claim 1, wherein said protective layer is obtained by aqueous solvent coating using a coating solution in which water is used as a main ingredient of a solvent.

10. The photothermographic material according to claim 1, wherein said protective layer contains a carboxylic acid residue-containing polymer in an amount of 100 mg/$m^2$ to 5 g/$m^2$ as a binder.

11. The photothermographic material according to claim 1, wherein the inorganic compound for forming said matte agent is barium sulfate, titanium dioxide, barium strontium sulfate or silicon dioxide and the organic polymer compound for forming said matte agent is polytetrafluoroethylene, cellulose acetate, polystyrene, polymethyl methacrylate, polyethylene carbonate or starch.

12. The photothermographic material according to claim 1, wherein said matte agent is a mixture of titanium oxide and of polymethyl methacrylate.

13. The photothermographic material according to claim 1, wherein the inorganic compound/organic polymer compound mixing weight ratio is from 0.001 to 1.

14. The photothermographic material according to claim 1, wherein the inorganic compound/organic polymer compound mixing weight ratio is from 0.01 to 0.5.

15. The photothermographic material according to claim 1, wherein the image formation layer contains a binder, an organic silver salt and a reducing agent.

16. The photothermographic material according to claim 1, wherein the image formation layer is formed by applying a coating solution in which 30% by weight or more of a solvent is water, and drying it, with the proviso that the main binder of the image formation layer comprises a polymer latex soluble or dispersible in an aqueous solvent.

17. A photothermographic material for laser exposure comprising a support having provided thereon at least one image formation layer containing at least one light-sensitive silver halide, and at least one non-image recording protective layer provided on the side far away from the support of said image formation layer, wherein said protective layer contains a matte agent composed of a homogeneous mixture of an inorganic compound and an organic polymer compound.

* * * * *